US010392902B2

(12) United States Patent
Kenison et al.

(10) Patent No.: US 10,392,902 B2
(45) Date of Patent: Aug. 27, 2019

(54) DOWNHOLE TOOL ANCHORING SYSTEM

(71) Applicant: Schlumberger Technology Corporation, Sugar Land, TX (US)

(72) Inventors: Michael Hayes Kenison, Richmond, TX (US); Zheng Rong Xu, Sugar Land, TX (US); Jeffrey Conner McCabe, Houston, TX (US); Robert Bucher, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 181 days.

(21) Appl. No.: 14/443,007

(22) PCT Filed: Nov. 21, 2013

(86) PCT No.: PCT/US2013/071292
§ 371 (c)(1),
(2) Date: May 14, 2015

(87) PCT Pub. No.: WO2014/081957
PCT Pub. Date: May 30, 2014

(65) Prior Publication Data

US 2015/0285031 A1 Oct. 8, 2015

Related U.S. Application Data

(60) Provisional application No. 61/729,065, filed on Nov. 21, 2012.

(51) Int. Cl.
*E21B 23/06* (2006.01)
*E21B 33/12* (2006.01)
(Continued)

(52) U.S. Cl.
CPC ..... *E21B 34/14* (2013.01); *E21B 23/06* (2013.01); *E21B 33/12* (2013.01); *E21B 34/101* (2013.01)

(58) Field of Classification Search
CPC ..... E21B 21/103; E21B 23/06; E21B 34/14; E21B 34/101; E21B 33/12
See application file for complete search history.

(56) References Cited

U.S. PATENT DOCUMENTS 3,503,445 A * 3/1970 Cochrum ..... E21B 21/103 166/151
4,340,088 A 7/1982 Geisow
(Continued)

FOREIGN PATENT DOCUMENTS

RU 2299316 C2 5/2007
SU 819310 12/1978
WO 2014081957 A1 5/2014

OTHER PUBLICATIONS

Maksutov et al., "Simultaneous operation of multilayer petroluem fields", Nedra publishers, 1974, pp. 168-169. (with English Translation).

(Continued)

*Primary Examiner* — David J Bagnell
*Assistant Examiner* — Jonathan Malikasim

(57) ABSTRACT

A technique facilitates the anchoring and use of a downhole tool. The technique may be utilized with operations in which fluid is pumped or otherwise flowed through a tubular to the downhole tool. The operations are performed after the downhole tool has been fixed relative to the wellbore and while the tubular remains connected to the downhole tool. In some operations, the downhole tool is manipulated from the surface via the tubular to control placement of the fluid flowing down through the tubular.

20 Claims, 8 Drawing Sheets

(51) Int. Cl.
*E21B 34/10* (2006.01)
*E21B 34/14* (2006.01)

(56) References Cited

U.S. PATENT DOCUMENTS

| | | | | |
|---|---|---|---|---|
| 4,940,095 | A * | 7/1990 | Newman | E21B 19/22 166/378 |
| 5,479,989 | A | 1/1996 | Shy et al. | |
| 5,782,306 | A * | 7/1998 | Serafin | E21B 33/1243 166/187 |
| 7,032,666 | B2 * | 4/2006 | Corbett | E21B 43/045 166/278 |
| 2004/0055755 | A1 | 3/2004 | Roesner et al. | |
| 2005/0000693 | A1 | 1/2005 | Ravensbergen et al. | |
| 2009/0151960 | A1 | 6/2009 | Rogers et al. | |
| 2012/0043079 | A1 * | 2/2012 | Wassouf | E21B 31/00 166/250.01 |
| 2012/0255738 | A1 * | 10/2012 | Lauderdale | E21B 34/063 166/373 |

OTHER PUBLICATIONS

International Search Report for International Application No. PCT/US2013/071292 dated Apr. 10, 2014.
Partial European Search Report issued in European Patent Appl. No. 13856844 dated Oct. 19, 2016; 5 pages.
Examination Report issued European Patent Appl. No. 13856844 dated Nov. 7, 2016; 5 pages.
Examination report isssued in European Patent Appl. No. 13856844.9 dated Jul. 24, 2017; 3 pages.

* cited by examiner 20
22
26
32
36
40
44
50
62
68
84
86
88
90
30
34
38
$P_{INT}$
$P_{UZ}$
$P_{LZ}$

DOWNHOLE TOOL ANCHORING SYSTEM

BACKGROUND

During wellbore operations, an anchor is sometimes used to anchor a downhole tool to a wellbore for isolation of one wellbore section from another. The anchoring may be accomplished via a packer, such as a mechanical or inflatable packer, which provides a seal to isolate pressure and fluid. The packer also may comprise an anchoring system to mechanically grip the wellbore and to prevent movement of the packer. Such packers may be installed in the wellbore by various devices, including slickline, wireline, or tubulars, e.g. jointed pipe or coiled tubing. The tubular also may be used to carry pumped treatment fluids along its interior for injection above or below the packer after installation of the packer.

SUMMARY

In general, a system and methodology are provided for anchoring and using a downhole tool. The technique may be utilized with operations in which fluid is pumped or otherwise flowed through a tubular to the downhole tool. The operations are performed after the downhole tool has been fixed relative to the wellbore and while the tubular remains connected to the downhole tool. In some operations, the downhole tool is manipulated from the surface via the tubular to control placement of the fluid flowing down through the tubular.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
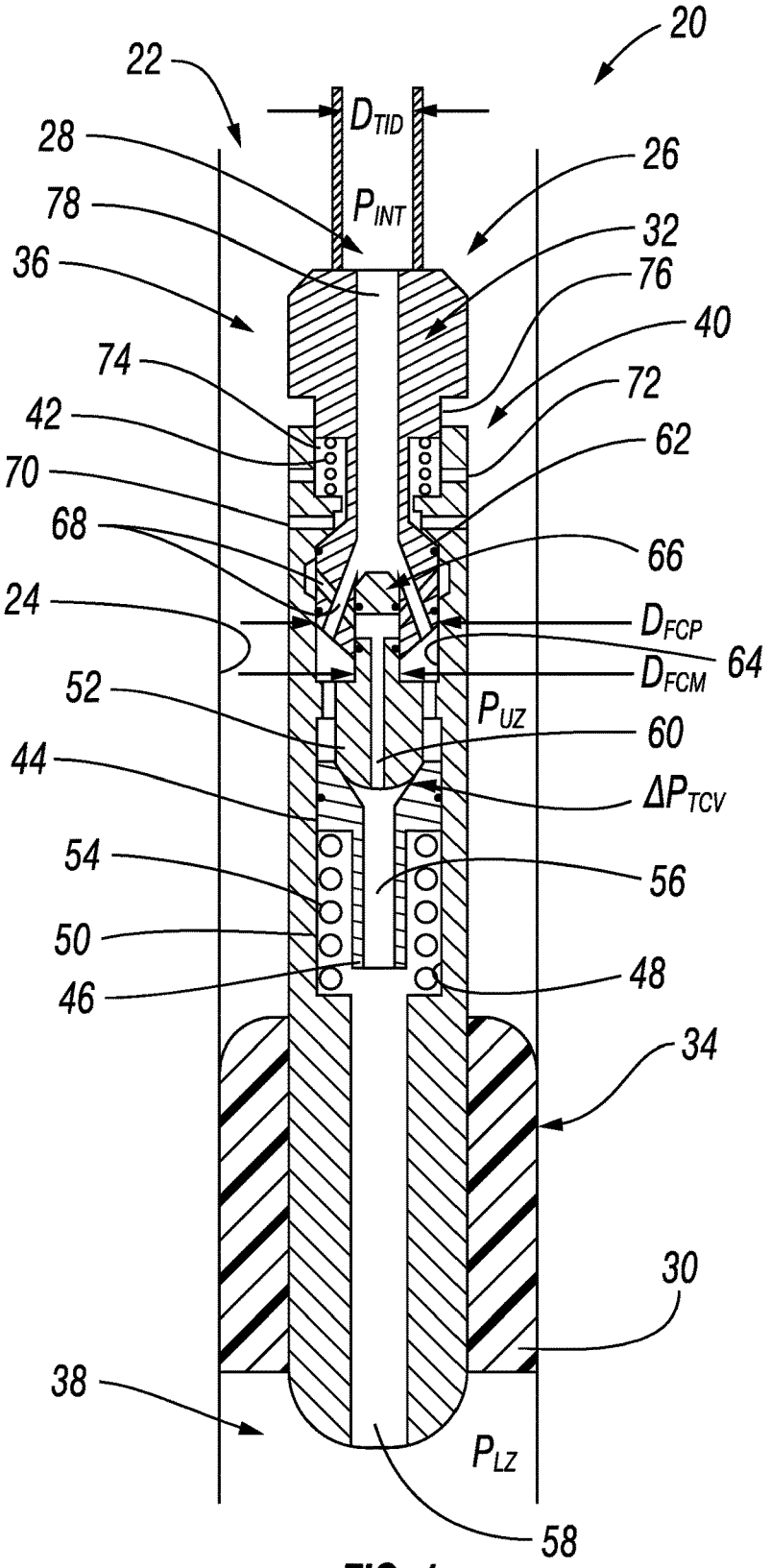
FIG. 1 is a cross-sectional illustration of a downhole tool deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to a downhole tool anchoring system. The system and methodology may be utilized with operations in which fluid is pumped or otherwise flowed through a tubular to a downhole tool. After the downhole tool has been fixed relative to the wellbore and while the tubular remains connected to the downhole tool, the desired operations may be performed. In some operations, the downhole tool is manipulated from the surface via the tubular to control placement of the fluid flowing down through the tubular. For example, the fluid may be directed to locations above or below an isolation device, such as a packer.

In an embodiment, a downhole tool anchoring system comprises a tool having an anchored section fixed relative to a wellbore. The tool also comprises a shifting section which may be moved relative to the wellbore by a tubular extending from the shifting section to a surface location. In this example, the tool further comprises an isolation device positioned to isolate pressure in a first section of the wellbore from pressure in a second section of the wellbore. For example, the isolation device may be used to isolate wellbore sections, e.g. well zones, on opposite sides of the isolation device. A valve system is located in the tool and allows fluid be pumped from the tubular into the wellbore, external to the tubular, while blocking flow of fluid from the wellbore into the tubular. The shifting section is movable to control whether the fluid flowing from the tubular exits above or below the isolation device. Additionally, the shifting section is configured to be movable without being directly affected by wellbore pressure below the isolation device.

In embodiments described herein, the downhole tool may be anchored to the wellbore, e.g. anchored to casing or to an open hole wellbore. The system may utilize an anchoring section combined with the isolation device to both anchor the tool and isolate pressure in one section of the wellbore from another. During normal operations, the anchoring section does not move relative to the wellbore. The shifting section, on the other hand, is movable with respect to the wellbore and may be mechanically manipulated from the surface.

The downhole tool anchoring system is designed so operation of the shifting section is not adversely affected by pressure in a downhole wellbore section, e.g. a lower zone of the wellbore below the isolation device. Otherwise, the combined effect from pressures in the lower zone can create a net axial force which causes difficulty with respect to operation of the shifting section in a consistent and reliable manner. This problem can be particularly problematic in wells, e.g. long horizontal wells, where a limited amount of force can be transferred to the downhole tool through the tubular. Embodiments described herein reduce or remove the effects of pressures in the lower zone. The lower zone is the wellbore section/zone which is on the downhole side of the isolation device in either vertical or deviated, e.g. horizontal, wellbores.

Referring generally to FIG. 1, an embodiment of a system 20, e.g. a well system, is illustrated as deployed in a wellbore 22. By way of example, wellbore 22 may be an open wellbore or a cased wellbore having a casing 24. The well system 20 comprises a tool 26 which may be delivered downhole by a conveyance 28, such as a tubular. The tubular 28 may comprise continuous pipe, e.g. coiled tubing, or connected sections, e.g. jointed pipe.

In the embodiment illustrated, the tool 26 comprises an anchored or anchoring section 30 which fixes the tool 26 relative to wellbore 22. Depending on the application, anchoring section 30 may be a mechanical device which is mechanically expanded, e.g. packer slips. In some applications, anchoring section 30 may be expanded and fixed to the surrounding wellbore via expansion of a packer, such as a packer inflated with fluid. The anchoring section 30 also may comprise a device which latches into a mating profile along wellbore 22, or it may comprise another suitable device for anchoring the tool 26. The illustrated tool 26 further comprises a shifting section 32 which may be moved relative to wellbore 22 by, for example, tubular 28. In this example, tubular 28 extends up through wellbore 22 to a surface location. Additionally, tool 26 comprises an isolation device 34, e.g. a packer, which may be selectively expanded against a surrounding wellbore wall to isolate fluid and pressure in a first section 36 of wellbore 22 from the fluid and pressure in a second section 38 of wellbore 22. The first section 36 and the second section 38 may be wellbore sections located on opposite sides of isolation device 34, e.g. above and below isolation device 34. As illustrated, tool 26 further comprises a valve system 40. (It should be noted that "above" refers to uphole and "below" refers to downhole relative to the isolation device when the isolation device is employed in deviated, e.g. horizontal, wells.)

Valve system 40 may have a variety of configurations with several types of components. In the example illustrated, valve system 40 is configured to allow fluid to be flowed, e.g. pumped, from the interior of tubular 28 and into wellbore 22, externally of tubular 28, while blocking flow of fluid from wellbore 22 into the tubular 28. The valve system 40 may be mechanically actuated by shifting section 32. The shifting section 32 is movable, e.g. linearly movable, to control actuation of valve system 40 and flow of fluid from tubular 28. For example, the shifting section 32 may be moved back or forth to control whether fluid flowing from tubular 28 exits above or below isolation device 34. It should be noted that in some applications, the shifting section 32 may comprise a shifting return spring 42 positioned to bias the shifting section 32 toward a desired default position. The configuration of well system 20 enables operation of shifting section 32 and actuation of valve system 40 without having the shifting section 32 directly affected by wellbore pressure downhole of isolation device 34 in wellbore section 38. In other words, the net pressure affected area in contact with wellbore pressure from wellbore section 38 is zero in the shifting section 32.

Referring again to the embodiment illustrated in FIG. 1, the valve system 40 may comprise a check valve 44 having a valve member 46 slidably disposed in a check valve chamber 48 within a valve housing 50. Check valve 44 may be used to control the flow of fluid from the tubular 28 into the wellbore 22. The valve member 46 may be biased toward sealing engagement with a fixed valve structure 52 via a spring member 54, e.g. a coil spring acting against valve member 46. The valve member 46 has an internal flow passage 56 in communication with a valve housing flow passage 58 which extends through isolation device 34 and into fluid communication with well zone 38 of wellbore 22 located on an opposite side of isolation device 34. The internal flow passage 56 also is in fluid communication with a corresponding, internal flow passage 60 of valve structure 52.

The spring member 54 biases valve member 46 into sealing engagement with valve structure 52 so that check valve 44 remains closed to flow of fluid from tubular 28 and down through flow passage 58 into section 38 of wellbore 22 until a predetermined cracking pressure is exceeded. The predetermined cracking pressure of check valve 44 is selected to prevent uncontrolled flow of fluid from the tubular 28 down into the wellbore 22. The check valve 44 also blocks flow of fluid from wellbore 22, e.g. from well section 38, into tubular 28.

The illustrated valve system 40 may further comprise a flow control piston 62 which is connected to shifting section 32 and is slidably movable within a piston chamber 64 of valve housing 50. The flow control piston 62 also slidably engages a flow control mandrel 66 which is received within flow control piston 62 and is coupled with valve structure 52. The flow control piston 62 further includes an internal flow channel network 68 which is explained in greater detail below. Additionally, a flow port 70 extends through valve housing 50 for communication between the surrounding wellbore 22 and a portion of piston chamber 64 on an opposite side of flow control piston 62 from valve structure 52. A vent port 72 also may extend through valve housing 50 for communication between the surrounding wellbore 22 and a chamber 74 slidably receiving a head portion 76 of shifting section 32. In the embodiment illustrated, the flow channel network 68 is in fluid communication with tubular 28 via a flow passage 78 extending through shifting section 32.

The tool 26 illustrated in FIG. 1 overcomes unwanted pressure effects from the lower wellbore section 38 that would otherwise act on shifting section 32. The tool 26 is anchored to the inside diameter of wellbore 22 by anchored section 30 which, in some embodiments, may be part of a packer forming isolation device 34. The isolation device 34 isolates the pressure in wellbore section 36, e.g. an upper zone pressure $P_{UZ}$, from the pressure in wellbore section 38, e.g. a lower zone pressure $P_{LZ}$. In this example, tubular 28 mechanically connects the shifting section 32 to the wellbore surface where a suitable surface device (e.g. a coiled tubing injector or the like) provides adequate axial force to selectively move the tubular 28 and the shifting section 32 back or forth, e.g. up or down. The tubular 28 also is configured so that fluid may be flowed, e.g. pumped, down from the wellbore surface through the inside of the tubular 28 and into flow passage 78 of shifting section 32. The flowing fluid is directed into either wellbore section 36 or wellbore section 38 depending on the linear position of shifting section 32. In the example shown in FIG. 1, the vent port 72 transmits pressure in well section 36 to the interior of the anchored section 30 so that this portion of the anchored section 30 is pressure balanced.

Figure 2:
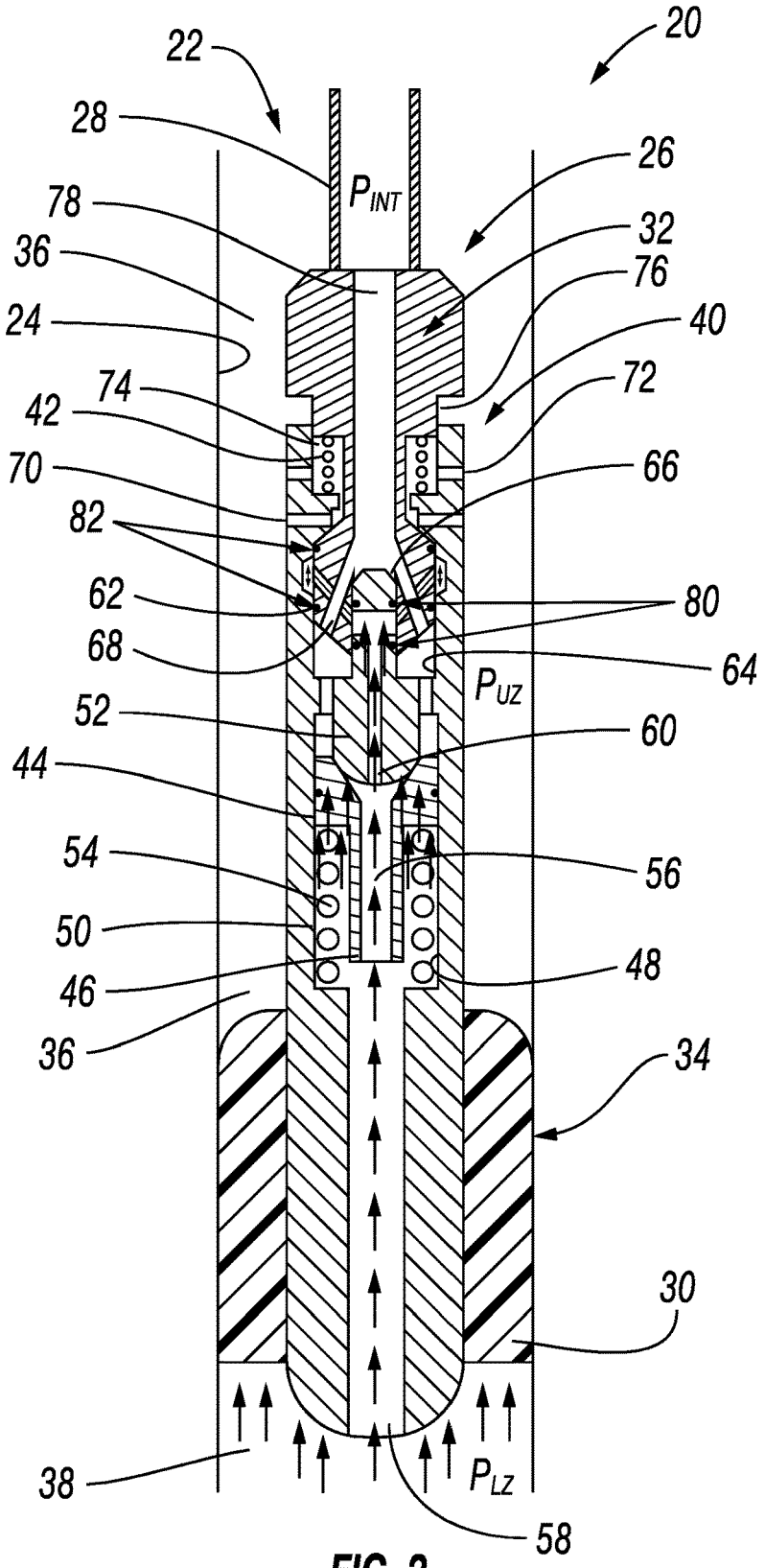
FIG. 2 is a cross-sectional illustration similar to that of FIG. 1 in which a valve system of the downhole tool blocks flow of fluid from the wellbore into a tubular used to deploy the downhole tool, according to an embodiment of the disclosure.

As further illustrated in FIG. 2, the configuration of tool 26 effectively isolates the shifting section 32 from the effects of pressure $P_{LZ}$ in the lower wellbore section/zone 38. Because the check valve 44 does not allow flow of fluid from wellbore section 38 into tubular 28, pressures in the lower wellbore section 38 acting on check valve 44 transfer force to the anchored section 30. The well section pressure $P_{LZ}$ also acts on the flow control mandrel 66 as represented by arrows in FIG. 2. The flow control mandrel 66 does not move relative to the anchored section 30. The pressure $P_{LZ}$ is allowed to pass through the flow control piston 62 between flow control mandrel seals 80 but is then blocked by flow control piston seals 82 on the flow control piston 62. As long as the flow control piston seals 82 have an equivalent seal diameter, $D_{FCP}$ (see FIG. 1), and the flow control mandrel seals 80 have an equivalent seal diameter, $D_{FCM}$ (see FIG. 1), then the net axial force generated by the pressure in well section 38 will be zero on the flow control piston 62 and the shifting section 32. The pressure-induced force from the pressure $P_{LZ}$ in wellbore section 38 is thus transferred to the anchored section 30.

Figures 3, 4, 5:
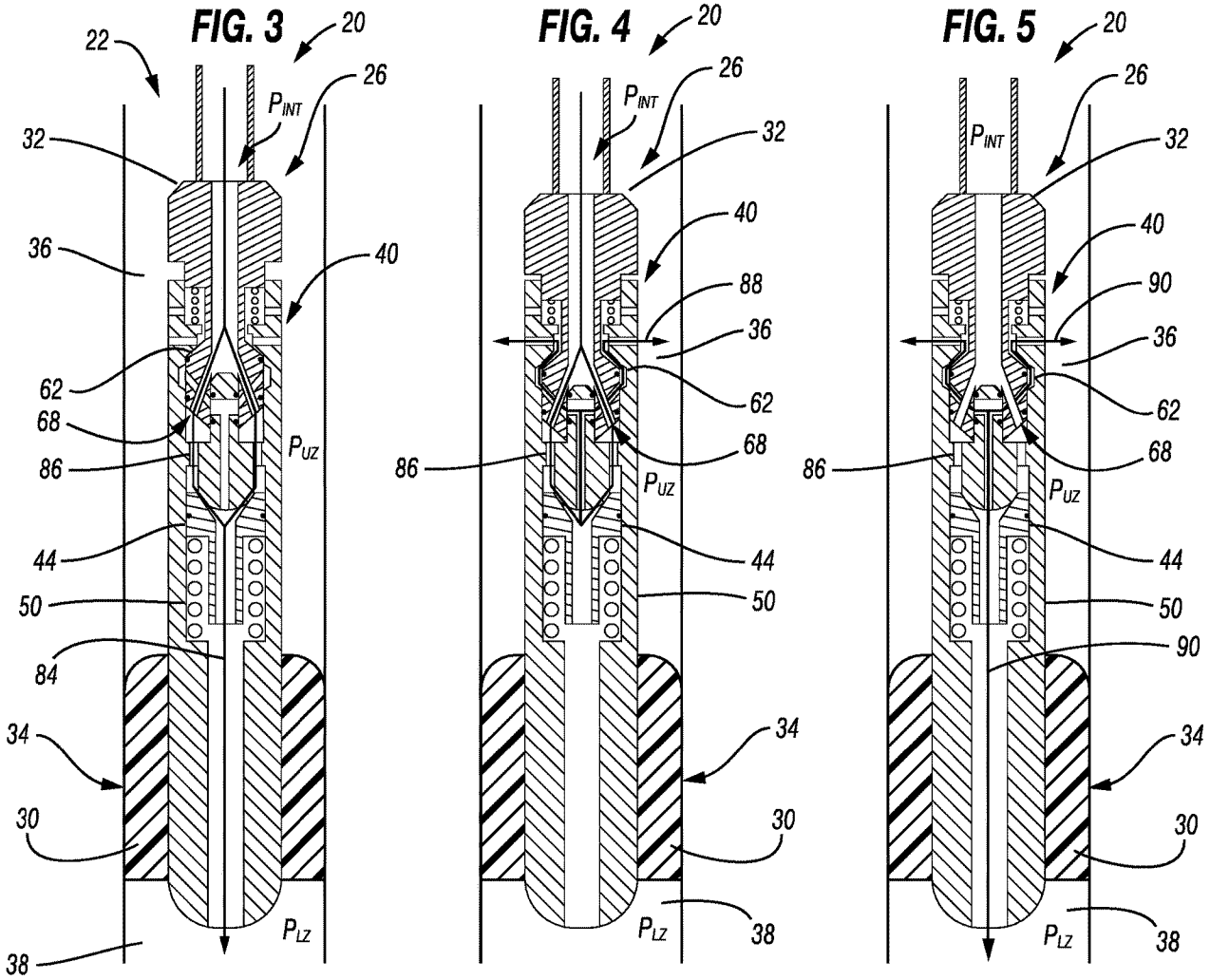
FIG. 3 is a cross-sectional illustration similar to that of FIG. 2 but showing the valve system in a different operational configuration, according to an embodiment of the disclosure.
FIG. 4 is a cross-sectional illustration similar to that of FIG. 3 but showing the valve system in a different operational configuration, according to an embodiment of the disclosure.
FIG. 5 is a cross-sectional illustration similar to that of FIG. 4 but showing the valve system in a different operational configuration, according to an embodiment of the disclosure.

Referring generally to FIGS. 3-5, operation of the shifting section 32 to control placement of fluid flowing from tubular 28 is illustrated. In FIG. 3, for example, the shifting section 32 is moved via tubing 28 to a position, e.g. an up position, which allows fluid to be flowed, e.g. pumped, as indicated by arrow 84. The fluid flow is directed down through the tubular 28, through the shifting section 32, through the flow control piston 62, through the flow control mandrel 66, past the check valve 44, and into the wellbore section 38, e.g. a lower zone of wellbore 22. In the particular embodiment illustrated, the fluid flow moves down through an interior of tubular 28, through flow passage 78 of shifting section 32, and into flow channel network 68 of flow control piston 62. Specific channels in channel network 68 direct the fluid flow to bypass passages 86 which route the fluid flow past the stationary flow control mandrel 66 and valve structure 52. The fluid flow generates sufficient pressure on the check valve 44 to exceed the predetermined cracking pressure of check valve 44 and to open the check valve so that fluid flow continues through check valve flow passage 56. From flow passage 56, the fluid flow is directed into flow passage 58 and past isolation device 34 into wellbore section 38.

In FIG. 4, the shifting section 32 has been shifted to another position, e.g. a down position. In this configuration, the fluid is flowed to wellbore section 36, e.g. an upper well zone, located on an opposite side of isolation device 34, as indicated by arrow 88. The fluid flow is directed down through the tubular 28, through the shifting section 32, through the flow control piston 62, past the flow control mandrel 66, back up through flow passage 60 and appropriate channels of flow channel network 68, out through flow ports 70, and into the wellbore section 36, e.g. an upper zone of wellbore 22 above isolation device 34. In the particular embodiment illustrated, the fluid flow moves down through an interior of tubular 28, through flow passage 78 of shifting section 32, and into flow channel network 68 of flow control piston 62. Specific channels in channel network 68 direct the fluid flow to bypass passages 86 which route the fluid flow past the stationary flow control mandrel 66 and valve structure 52 before allowing the fluid to overcome the cracking pressure of the check valve 44 so that the fluid can flow back through flow passage 60 of valve structure 52. From valve structure 52 and flow control mandrel 66, the fluid is routed through separate channels in channel network 68 and out into well section 36 via the flow ports 70. As illustrated, the "down" and "up" flow paths of flow channel network 68 through flow control piston 62 are isolated from each other. In the specific example illustrated, the fluid is not blocked from flowing down through flow passage 56 and flow passage 58.

As illustrated in FIG. 5, the shifting section 32 may be shifted to a position establishing communication between well section 36 and well section 38 on opposite sides of isolation device 34, as indicated by arrows 90. This position allows pressure balancing across isolation device 34. For example, an operator may shift the shifting section 32 and valve system 40 to this pressure balanced position so as to balance pressure across a packer/isolation device 34 before unsetting the packer, thus helping reduce the potential for damage to the packer.

In addition to allowing flow down but not up into the tubular 28, the check valve 44 may serve other purposes. (Please note that usage of the terms "down" and "up" herein are for explanatory purposes relative to the orientation of the figures and those terms are not intended to limit the orientation of the well system. For example, "down" and "up" may represent "right" and "left" in a horizontal well extending to the right.) FIGS. 3 and 4 illustrate that, regardless of whether the fluid is pumped into the well section 36 or the well section 38, the fluid travels across the check valve 44. In subhydrostatic wells, the internal hydrostatic pressure $P_{INT}$ in tubular 28 at the downhole tool 26 may be higher than the hydrostatic pressure in the wellbore sections 36 and 38. The spring tension of the spring member 54 may be selected to compensate for the pressure imbalance between the tubular 28 and the wellbore 22, in both wellbore zone 36 and wellbore zone 38. Because the flow port 70 is above the check valve 44, the pressure-induced force acting on the check valve 44 is transmitted entirely to the anchored section 30 and does not affect control of the shifting section 32.

The tool design enables isolation of the shifting section 32 from undesirable pressure effects on the tubular 28 and the downhole tool 26. In the downhole tool shown in FIG. 1, the force acting on the shifting section 32 can be a force applied from surface plus a hydraulic force (a force generated by differential pressure between the tubular 28 and wellbore 22) inside the downhole tool 26 if the differential pressure is not compensated. The hydraulic force acting on the downhole tool can be calculated by:

$$F_H=(P_{INT}-P_{UZ})(D_{TID}^2-D_{FCP}^2)\pi/4$$

Where:

$F_H$—force acting on the tool due to pressure; +: downwards, −: upwards;

$P_{INT}$—pressure inside the tubular;

$P_{UZ}$—pressure in the wellbore section 36, e.g. upper zone;

$D_{TID}$—inner diameter of tubular;

$D_{FCP}$—sealing diameter of the flow control piston.

The hydraulic force $F_H$ acting on the downhole tool 26 can affect normal tool manipulation without compensating for the pressure differential. For example, if this hydraulic force $F_H$ is in the opposite direction of the force to shift the tool 26, then the force applied from surface would have to overcome this hydraulic force before generating adequate force to shift the tool 26. However, the configuration of tool 26 enables cancellation of the undesirable forces due to the pressure differential.

To facilitate an understanding of the function of tool 26, the hydraulic force acting on tool 26 may be described as a function of the pressures and seal diameters. By making the seal diameter of the tubular 28 equal to the seal diameter of the flow control piston 62, the resultant force $F_H$ is zero. In some combinations of tubular and tool diameters such relative sizing may not be practical.

Figure 6:
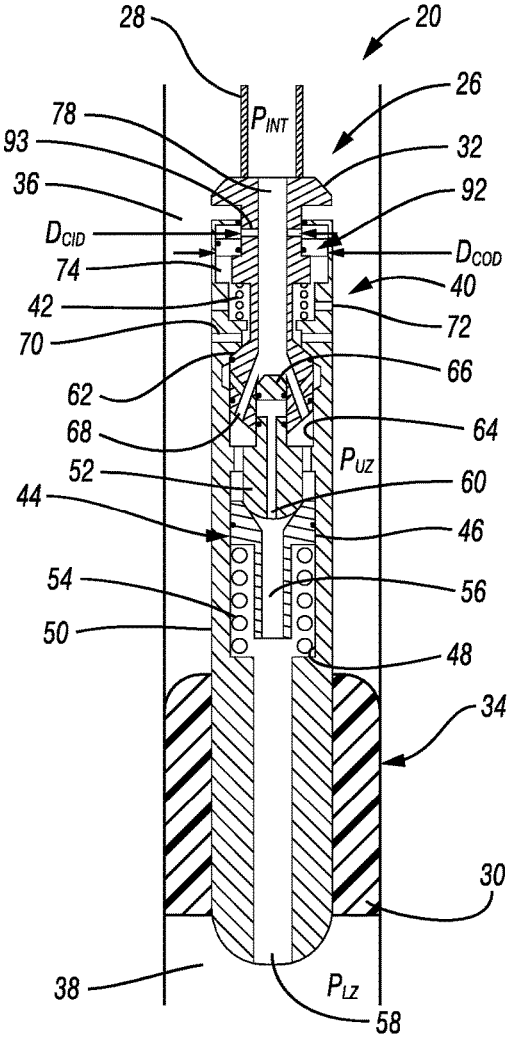
FIG. 6 is a cross-sectional illustration of another example of the downhole tool having a pressure compensator, according to an embodiment of the disclosure.

In many applications, however, the hydraulic force $F_H$ may be canceled by combining a pressure compensator 92 (see FIGS. 6 and 7) with the shifting section 32 and placing the pressure compensator 92 in communication with internal pressure, e.g. pressure in flow passage 78, via an internal vent port 93, as illustrated in FIG. 6. The illustrated pressure compensator 92 has two differential seal diameters that may be adjusted or selected to control the resulting hydraulic force. In this example, the hydraulic force acting on the downhole tool is given by:

$$F_H=(P_{INT}-P_{UZ})\pi/4((D_{TID}^2-D_{FCP}^2)+(D_{COD}^2-D_{CID}^2))$$

Where:

$D_{COD}$—outer diameter of the pressure compensator 92; and $D_{CID}$—inner diameter of the pressure compensator 92.

Figure 7:
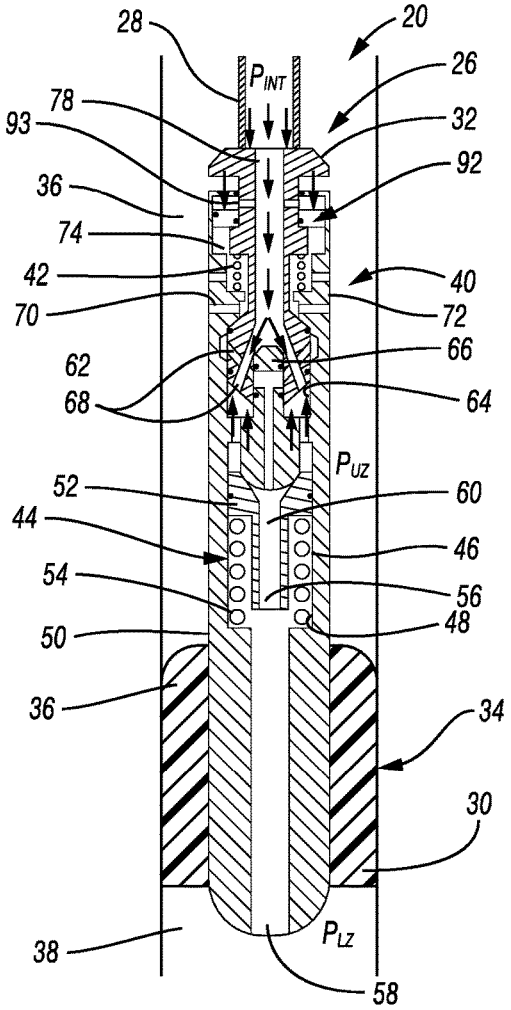
FIG. 7 is a cross-sectional illustration similar to that of FIG. 6 showing pressure acting on the pressure compensator, according to an embodiment of the disclosure.

By designing the seal diameters of the pressure compensator 92 to meet the following equation, the resultant hydraulic force acting on the tool 26 can be canceled, as illustrated by the arrows in FIG. 7.

$$D_{TID}^2-D_{FCP}^2=(D_{COD}^2-D_{CID}^2)$$

Because the hydraulic force is canceled, the force to shift the tool 26 via tubular 28 is independent of the downhole pressure differential that is applied directly to the pressure affected surface areas of the shifting section 32. It should be noted that the tubular inner diameter $D_{TID}$ may vary for a given tubular outer diameter, for instance due to different values of tubular wall thickness. It may be possible to generate adequate or substantial pressure compensation without exactly satisfying the above equation, for instance by using an average value of $D_{TID}$. Such an approach is within the scope of the present disclosure.

By a similar procedure, the pressure compensator 92 also may be used to control other unwanted pressure effects. For example, when differential pressure is applied to the tubular 28, the tubular 28 tends to shorten because of the Poisson effect. The shifting section 32 may be designed to substantially cancel the axial force due to length changes caused by changes in differential pressure between the tubular 28 and the wellbore 22 while restricting those changes in the tubular length. Because of the constraints at both ends of the tubular 28 (e.g. downhole anchor or packer and surface control system), an increase in differential pressure generates a net upward force on the shifting section 32 that works to prevent the tubular 28 from shortening. If the wellbore pressure stays relatively constant while anchored, then the force from the Poisson effect due to the change (from the point of anchoring) in differential pressure across the tubular 28 is given by:

$$F_P32-\pi/2\mu D_{TID}^2((P_{INT}-P_{UZ})_{OP}-(P_{INT}-P_{UZ})_{ANC})$$

Where:

$\mu$—Poisson's ratio for the material of the tubular;

$(P_{INT}-P_{UZ})_{OP}$—differential pressure across the tubular at some point during the operation; and $(P_{INT}-P_{UZ})_{ANC}$—differential pressure across the tubular at the point of anchoring.

As a result, the downhole force management is affected. The pressure-induced force acting on the shifting section 32 can now be given by:

$$F_{press}=F_H+F_P$$

That is:

$$F_{press}=(P_{INT}-P_{UZ})[\pi/4((D_{TID}^2-D_{FCP}^2)+(D_{COD}^2-D_{CID}^2)-2\mu D_{TID}^2)]=[\pi/2\mu D_{TID}^2(P_{INT}-P_{UZ})_{ANC}]$$

Thus, $F_{press}$ is a linear equation with a slope that is proportional to the operational differential pressure, and a constant offset that is a function of the differential pressure at the point of anchoring. In this example, the system is not configured to compensate for the constant offset since we do not know at what differential pressure the system will be anchored. However, $F_{press}$ may be designed to be insensitive to changes in operational differential pressure by setting the slope equal to zero. Setting the slope of $F_{press}$ equal to zero and rearranging gives the following expression, which relates the seal diameters of the pressure compensator 92 to the inside diameter of tubular 28 and the seal diameters of the flow control piston 62:

$$D_{COD}^2-D_{CID}^2=D_{FCP}^2-(1-2\mu)D_{TID}^2$$

The pressure compensator 92 is illustrated herein as a separate piston added to the shifting section 32. However, the pressure compensator 92 may be implemented in other ways and may be integral with the tool or added to the tool. In the embodiments described herein, the pressure affected area, $A_{PC}$, of the pressure compensator 92 meets the following:

$$A_{PC}=\pi/4(D_{FCP}^2-(1-2\mu)D_{TID}^2)$$

Figure 8:
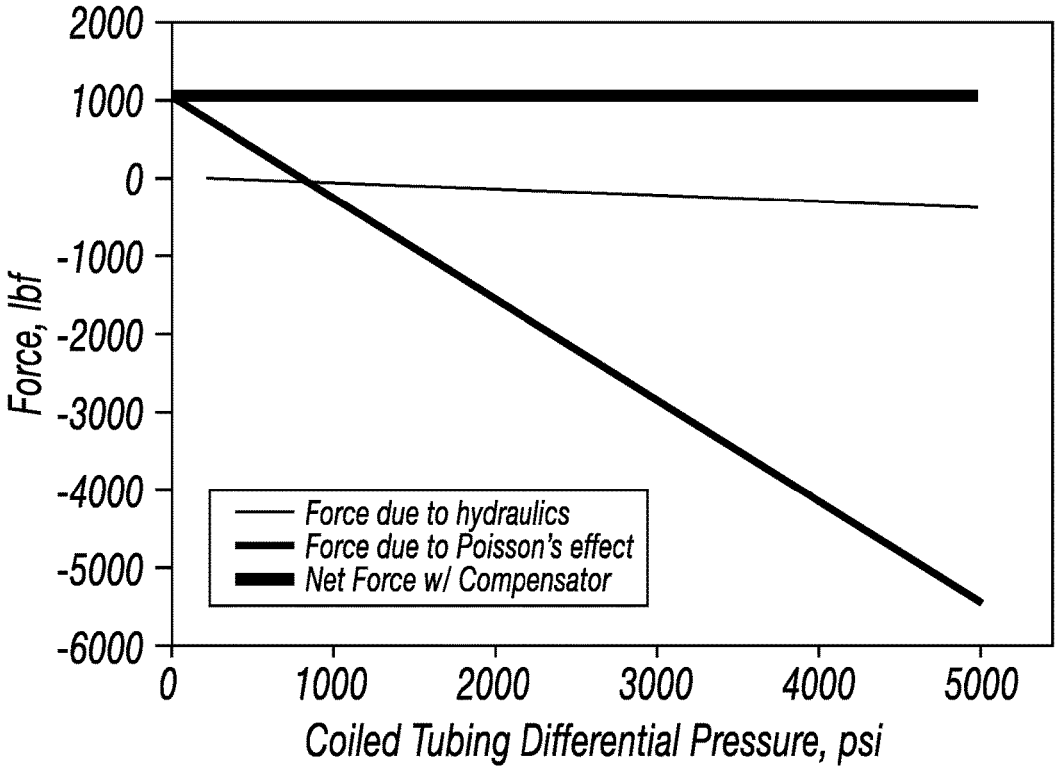
FIG. 8 is a graphical illustration in which tubing differential pressure is plotted versus force, according to an embodiment of the disclosure.

This equation illustrates that the differential pressure induced force can theoretically be held constant, regardless of the values of $P_{INT}$ and $P_{UZ}$, by choosing or selecting appropriate seal diameters for the pressure compensator 92. In FIG. 8, a graphical representation is provided of the differential pressure of coiled tubing (e.g. tubing 28) versus force applied to the coiled tubing. The specific example of coiled tubing is a 2 inch outer diameter coiled tubing experiencing an initial force at anchoring of about 1,000 lbs, though other sizes and forces remain with the scope of the present disclosure. The graph comprises data plots representing force due to hydraulics 94, force due to Poisson's effect 96, and the net force 98 with pressure compensator 92. With an appropriate pressure compensator 92, the net force acting on the shifting section 32 is independent of the operational differential pressure, so the overall force stays constant at the initial value. The pressure compensator 92, therefore, is configured to compensate for axial force changes due to changes in a pressure differential between an interior and an exterior of the tubular 28, e.g., the exterior pressure in the wellbore 22 exterior of the tubular 28. As a result, the shifting section 32 can be manipulated more reliably and can be used deeper in horizontal wells where force transmission is difficult.

It should be noted that the above analysis assumes that the pressure in wellbore section/zone 36 is constant and that the differential pressure is changing. This does not mean that the pressure in wellbore section 36 has to be zero, but rather that the pressure in wellbore section 36 does not change after anchoring. Such an assumption is a reasonable approximation for many packer operations, particularly where the treated zone is straddled by two packers. In an embodiment, the tool 26 may comprise a second compensator piston to cancel the effect of changing pressure in the wellbore section 36, e.g. a zone above isolation device 34.

As described briefly above, the valve system 40 of tool 26 enables control of fluid flow with respect to directing fluid flow to wellbore section 36 and wellbore section 38. FIGS. 3-5 illustrate an embodiment of check valve 44 which enables managing of a hydrostatic imbalance (higher tubular hydrostatic pressure than wellbore hydrostatic pressure) when pumping to a selected section or zone of the wellbore, e.g. wellbore section 36 or wellbore section 38. Consequently, the flow path to the wellbore section 36, e.g. upper zone, is not completely isolated from the wellbore section 38, e.g. lower zone. In this type of embodiment, when the flow control piston 62 is positioned to direct the fluid flow to the wellbore section 36 the fluid also can be flowed, e.g. pumped, into the wellbore section 38.

However, the wellbore section 36 may be fully isolated from the lower wellbore section 38 in each position of the flow control piston 62. In this latter example, the check valve 44 may be designed so as to not support the hydrostatic imbalance in one of the flow control piston positions. In another example, the shifting section 32 and valve system 40 may be designed to utilize additional shifting below the check valve 44 which would transfer pressure-induced force to the shifting section 32.

Figure 9:
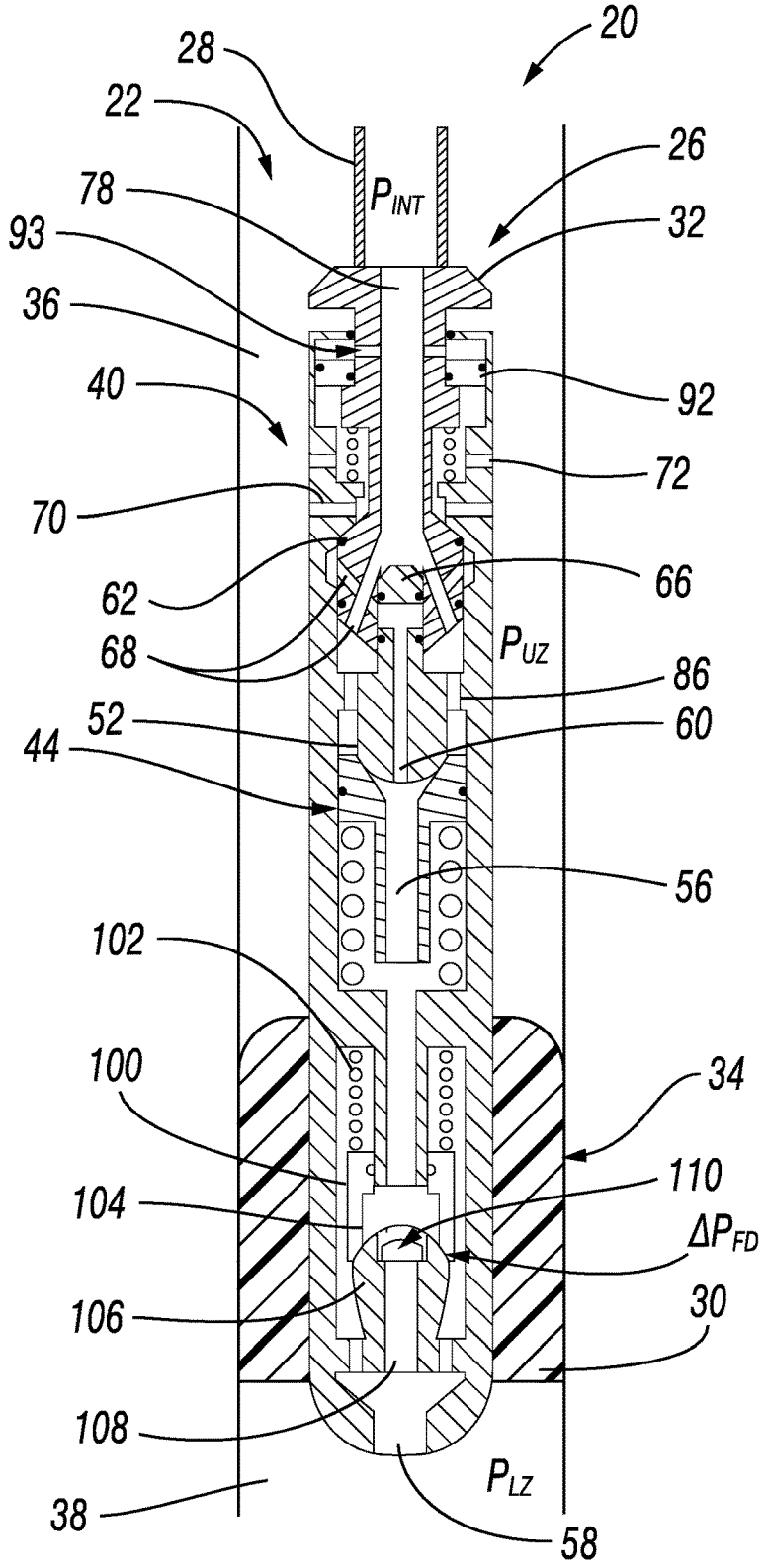
FIG. 9 is a cross-sectional illustration of another example of the downhole tool including a diverter check valve, according to an embodiment of the disclosure.

Referring generally to FIG. 9, another embodiment is illustrated in a configuration able to better control fluid placement while maintaining hydrostatic pressure control and without additional physical shifting (e.g. through the tubular 28). In this example, a flow diverter 100 is used in tool 26. The flow diverter 100 allows downward flow when a predetermined cracking pressure is reached ($\Delta P_{FD}$ in FIG. 9). This cracking pressure is controlled by properly selecting and/or adjusting a diverter pressure spring 102 which biases a valve member 104 toward sealing engagement with a corresponding valve member 106 having an internal flow passage 108. In some applications, the flow diverter 100 may be designed to block flow from wellbore section 38 to tubular 28, e.g. to block upward flow in the illustrated embodiment. However, such upward flow may be desirable in some applications to equalize pressure across the packer or other isolation device 34. In the latter example, a diverter check valve 110 may be provided to allow this upward flow with minimal pressure restriction, while forcing all downward flow across the flow diverter 100.

Figure 10:
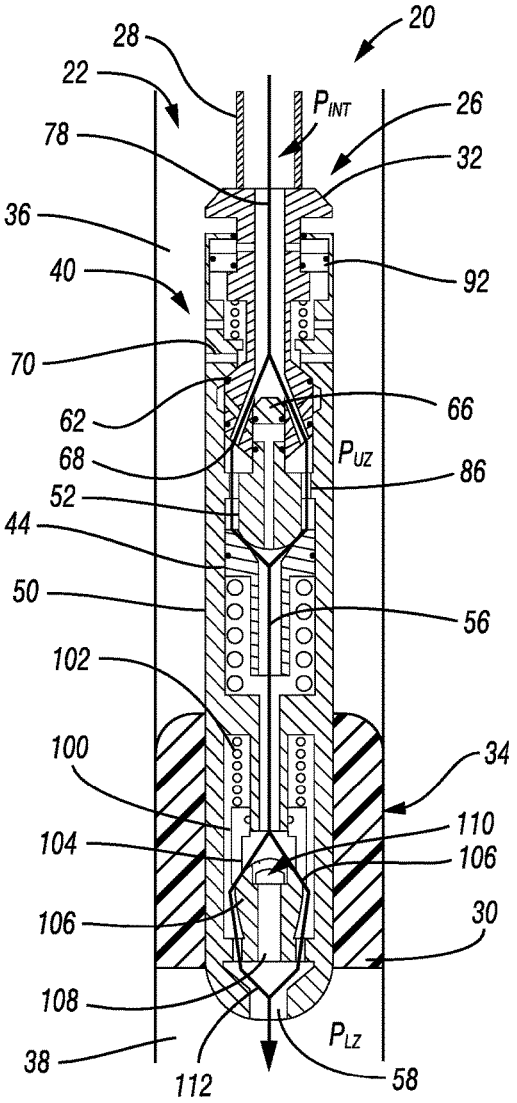
FIG. 10 is a cross-sectional illustration similar to that of FIG. 9 but showing the valve system in a different operational configuration, according to an embodiment of the disclosure.
Figure 11:
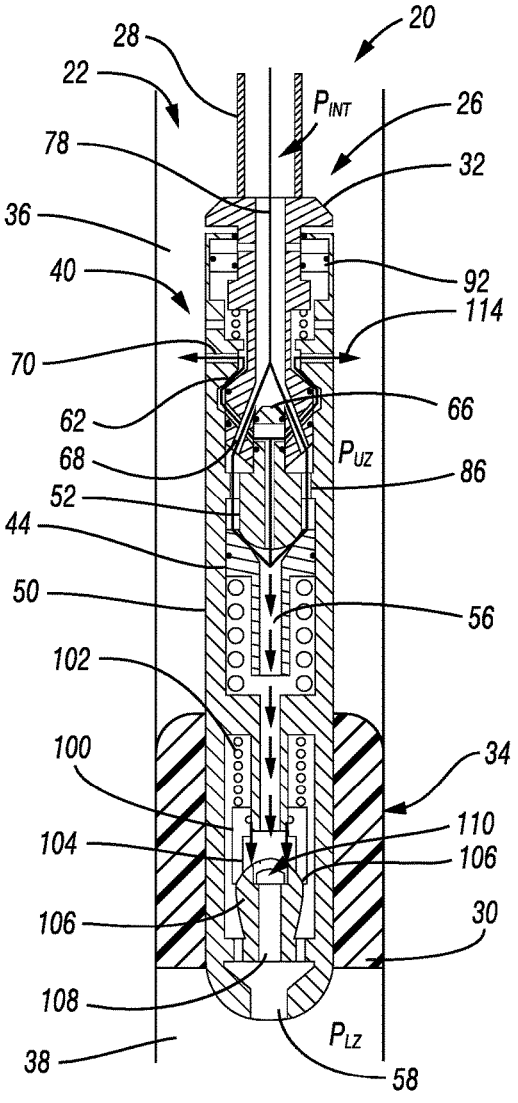
FIG. 11 is a cross-sectional illustration similar to that of FIG. 10 but showing the valve system and the diverter valve in a different operational configuration, according to an embodiment of the disclosure.

Operation of the flow diverter 100 and diverter check valve 110 when fluid is pumped downhole from the surface is illustrated in FIGS. 10 and 11. In FIG. 10, for example, the shifting section 32 is positioned via tubular 28 so that the entire flow of fluid moves from tubular 28 through isolation device 34 and into the wellbore section 38, as indicated by arrow 112. The downward flow of fluid is under sufficient pressure to overcome the cracking pressures of both the check valve 44 and the flow diverter 100 to enable fluid flow into wellbore section/zone 38 on an opposite side of the isolation device 34. In FIG. 11, the shifting section 32 is shifted to another position which directs the fluid flow into the wellbore section/zone 36, as indicated by arrows 114. When the following condition is met, the pumped fluid does not travel into wellbore section 38:

$$\Delta P_{FD} \geq (P_{UZ} - P_{LZ})$$

In practice, the flow diverter cracking pressure may be set sufficiently high to allow for additional pressure drop due to fluid flow through the tool 26. In some applications, some fluid flow may be allowed into the wellbore section/zone 38, e.g. a lower zone, as long as the majority of the flowing fluid exits into the wellbore section/zone 36 when in the operational configuration illustrated in FIG. 11. Accordingly in such an application, flow diverter 100 acts as a uni-directional valve similar to check valve 44 so as to enable further regulation of fluid flow to the wellbore 22 on a selected side of isolation device 34.

Figure 12:
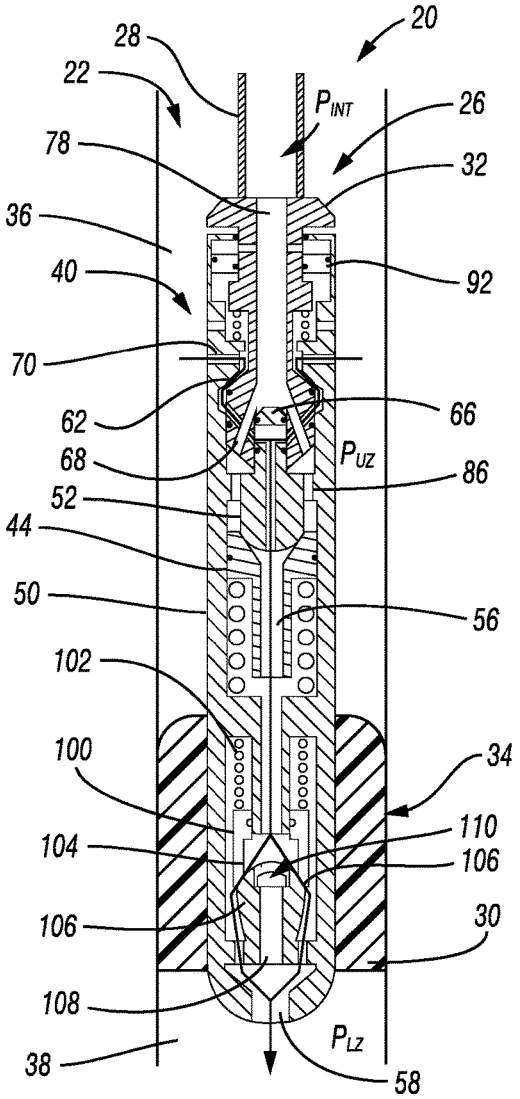
FIG. 12 is a cross-sectional illustration similar to that of FIG. 11 but showing the valve system and the diverter valve in a different operational configuration, according to an embodiment of the disclosure.
Figure 13:
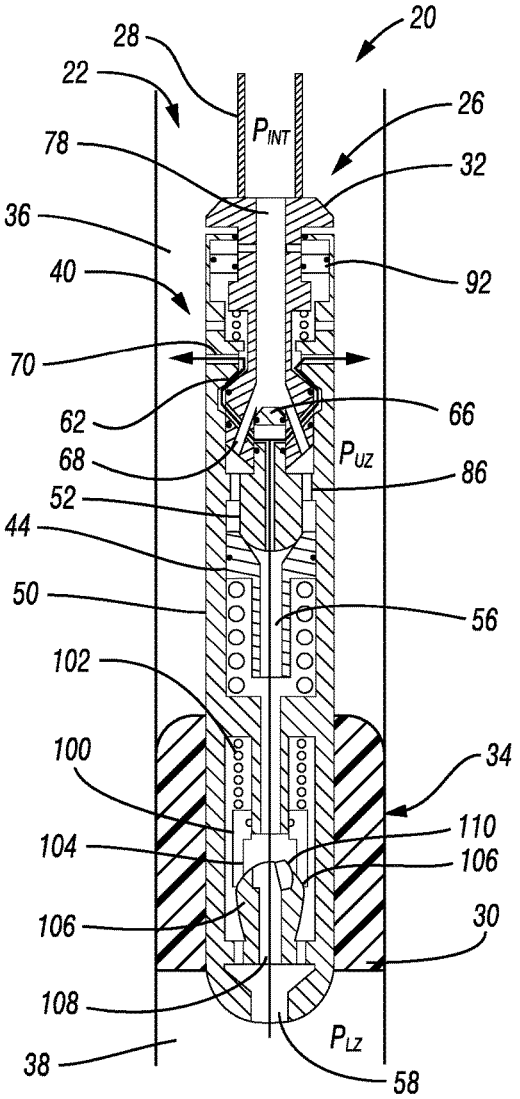
FIG. 13 is a cross-sectional illustration similar to that of FIG. 12 but showing the valve system and the diverter valve in a different operational configuration, according to an embodiment of the disclosure.

In some applications, the tool 26 also may be used to equalize pressure between the wellbore section 36 and the wellbore section 38. By way of example, the pressure equalization may be conducted prior to unsetting the packer or other isolation device 34. In FIG. 12, for example, an embodiment is illustrated in which the wellbore section 36 has higher pressure than the wellbore section 38. Consequently, wellbore fluid travels from the wellbore section 36 and across the flow diverter 100 to the wellbore section 38, as illustrated by arrow 116. As a result, the pressure in this direction is not equalized until the difference in pressures in wellbore section 36 and wellbore section 38 are equal to the flow diverter cracking pressure. In the example illustrated in FIG. 13, the wellbore section 38 has a higher pressure than the wellbore section 36. Consequently, the wellbore fluid travels up through the diverter check valve 110 (which is designed to offer minimal resistance to flow—typically much less than the flow diverter 100), through the tool 26, and into the wellbore section/zone 36, as illustrated by arrows 118. The diverter check valve 110, therefore, further biases fluid flow.

Depending on the application, the well system 20 and tool 26 may have a variety of configurations and may be used in many types of applications. Additionally, tool 26 may be used in tubing applications other than well related applications in which control is exercised over the flow of fluid to isolated zones. In well applications, tool 26 may be used in many types of cased and open borehole wells including vertical wells and deviated wells, e.g. horizontal wells. Additionally, tool 26 may be designed with a plurality, e.g. two, pressure isolation devices or packers 34, as will be appreciated by those skilled in the art. In such embodiments, the pressure isolation devices 34 can be used to straddle and thereby isolate a zone in a wellbore, and the shifting section 32 and valve system 40 may be used to selectively direct fluid flow to the zone between pressure isolation devices.

Many types of tubulars or other conveyances may be used to deliver tool 26 downhole. The components of tool 26 also may be adjusted to accommodate a given application or environment. For example, several types of isolation devices, e.g. packers, may be employed to isolate wellbore sections from each other. The downhole tool 26 also may use many types, sizes, and arrangements of components made from various materials suitable to a given operation. The types of check valves, spring members, sealing surfaces, seals, pressure compensators, and/or other tool components may have various configurations and may be arranged in several configurations to achieve the desired functionality for a given environment and operation. The tool 26 may be utilized with tubular 28, such as coiled tubing, for well treatment operations involving fluids, with one or more fluids being pumped into the wellbore through the hollow core of coiled tubing or down the annulus between the coiled tubing and the wellbore. Such treatment operations may include, but are not limited to, circulating the well, cleaning fill, stimulating the reservoir, removing scale, fracturing, isolating zones, etc. The well treatment operation may comprise injecting at least one fluid into the wellbore, such as injecting a fluid into the coiled tubing, into the wellbore annulus, or both. In some operations, more than one fluid may be injected or different fluids may be injected into the coiled tubing and the annulus. The well treatment operation may comprise providing fluids to stimulate hydrocarbon flow or to impede water flow from a subterranean formation. The well treatment operation may comprise a matrix stimulation operation, a fracturing operation, or the like. The tool 26 may be utilized with tubular 28, such as coiled tubing, for performing intervention operations such as, but not limited to, perforating operations, shifting operations, fishing operations, logging operations, or the like, as will be appreciated by those skilled in the art.

As noted above, in an embodiment, the tool 26 may be configured to compensate for pressure changes in the tubular 28, e.g., differential pressure, but the tool 26 may still affected by pressure below the isolation device 34, such as by removing the check valve 44 from the tool 26. Such an embodiment may be advantageous where the effects from differential pressure in the tubular 28 are anticipated to be much greater than the effects from pressure below the isolation device 34.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a wellbore, comprising:

a tool disposed on a tubular, the tool and tubular removably deployable into and out of the wellbore, the tool having:

an anchored section fixed relative to the wellbore;

a shifting section movable relative to the wellbore by the tubular extending to a surface location;

a single isolation device isolating pressure in a first section of the wellbore from pressure in a second section of the wellbore; and a valve system located in the tool to allow fluid to be pumped from the tubular into the wellbore while blocking flow of fluid from the wellbore into the tubular, the shifting section being movable, without being substantially affected by wellbore pressure below the isolation device, to control whether the fluid flowing from the tubular exits above or below the isolation device while the isolation device is isolating pressure in the first and second sections of the wellbore.

2. The system as recited in claim 1, wherein the valve system comprises a check valve having a predetermined cracking pressure selected to prevent uncontrolled flow of fluid from the tubular into the wellbore.

3. The system as recited in claim 1, wherein the shifting section is shiftable to a position establishing communication between the first section and the second section on opposite sides of the isolation device.

4. The system as recited in claim 1, wherein the shifting section compensates for changes in axial force acting on the shifting section due to changes in differential pressure between an interior of the tubular and the wellbore external to the tubular.

5. The system as recited in claim 1, wherein the valve system comprises a shiftable flow control piston coupled to the shifting section.

6. The system as recited in claim 1, wherein the isolation device comprises a packer.

7. The system as recited in claim 1, wherein the shifting section comprises a shifting return spring positioned to bias the shifting section in a desired direction.

8. The system as recited in claim 1, wherein the shifting section is combined with a pressure compensator in communication with an interior of the tubular via an internal vent port.

9. The system as recited in claim 1, wherein the tool further comprises a diverter check valve positioned downstream of the check valve to further bias fluid flow from the tubular into either the wellbore above or below the isolation device.

10. A method, comprising:

disposing a tubular comprising a tool in a wellbore, the tool comprising an anchoring section, a single isolation device, and a valve system, the valve system configured to control fluid flow from the tubular and into the tool;

anchoring the tool in the wellbore with the anchoring section;

isolating sections of the wellbore on opposing sides of the isolation device by setting the isolation device;

actuating the valve system in the tool to enable fluid to be flowed from the tubular into the wellbore external to the tubular while blocking flow of the fluid from the wellbore into the tubular;

controlling flow of the fluid from the tubular to a location on either side of the isolation device by actuating the valve system with a shifting section coupled to the tubular;

compensating for pressure below the isolation device to limit the effect of pressure below the isolation device on the shifting section while the isolation device is isolating the sections of the wellbore; and performing at least one of a wellbore operation and an intervention operation with the tool in the wellbore.

11. The method as recited in claim 10, wherein controlling comprises shifting the shifting section linearly via the tubular.

12. The method as recited in claim 10, wherein compensating further comprises locating a pressure compensator in the shifting section.

13. The method as recited in claim 10, further comprising using a check valve in the valve system to limit uncontrolled flow of fluid from the tubular into the wellbore.

14. The method as recited in claim 13, further comprising locating a diverter check valve in series with the check valve.

15. The method as recited in claim 10, wherein controlling comprises moving a flow control piston to selectively direct fluid from the tubular to a location above the isolation device or to a location below the isolation device.

16. The method as recited in claim 15, wherein controlling further comprises moving the flow control piston to a position which allows communication between the location above the isolation device and the location below the isolation device.

17. The method as recited in claim 10, wherein compensating comprises compensating for changes in axial force acting on the shifting section due to changes in differential pressure between an interior of the tubular and the wellbore external to the tubular.

18. A system for use in a wellbore, comprising:

a tubular comprising continuous pipe extending from a wellbore surface and removably deployable within the wellbore;

an anchored section of the tubular within the wellbore and fixed with respect to the wellbore, the anchored section comprising a single isolation device coupled thereto;

a valve system of the tubular controlling flow of fluid from the tubular to wellbore locations above and below the isolation device; and a shifting section coupled to the valve system and shifted by the tubular, the shifting section comprising a pressure compensator in communication with an interior of the tubular, the shifting section being shiftable to actuate the valve system so as to selectively control flow of fluid from the tubular to the wellbore locations above and below the isolation device while the isolation device is isolating the sections of the wellbore.

19. The system as recited in claim 18, wherein the pressure compensator is configured to compensate for axial force changes due to changes in a pressure differential between an interior and an exterior of the tubular.

20. The system as recited in claim 18, wherein the tubular comprises coiled tubing and wherein the tool is configured to perform at least one of a wellbore operation and an intervention operation when deployed within the wellbore.

* * * * *